US012140001B2

(12) United States Patent
Haukelidsæter Eidesen et al.

(10) Patent No.: US 12,140,001 B2
(45) Date of Patent: Nov. 12, 2024

(54) BUOY FOR INJECTING FLUID IN A SUBTERRANEAN VOID AND METHODS FOR CONNECTING AND DISCONNECTING A FLUID PASSAGE FROM A VESSEL TO THE BUOY

(71) Applicant: HORISONT ENERGI AS, Sandnes (NO)

(72) Inventors: Bjørgulf Haukelidsæter Eidesen, Stavanger (NO); Ståle Brattebø, Tananger (NO)

(73) Assignee: HORISONT ENERGI AS (NO)

( * ) Notice: Subject to any disclaimer, the term of this patent is extended or adjusted under 35 U.S.C. 154(b) by 0 days.

(21) Appl. No.: 18/280,315

(22) PCT Filed: Mar. 2, 2022

(86) PCT No.: PCT/EP2022/055218
§ 371 (c)(1),
(2) Date: Sep. 5, 2023

(87) PCT Pub. No.: WO2022/184752
PCT Pub. Date: Sep. 9, 2022

(65) Prior Publication Data

US 2024/0068332 A1 Feb. 29, 2024

(30) Foreign Application Priority Data

Mar. 5, 2021 (EP) ..... 21160935

(51) Int. Cl.
*E21B 43/01* (2006.01)
*B63B 22/02* (2006.01)
(Continued)

(52) U.S. Cl.
CPC ..... *E21B 43/0107* (2013.01); *B63B 22/021* (2013.01); *E21B 17/012* (2013.01);
(Continued)

(58) Field of Classification Search
CPC .. E21B 43/0107; E21B 43/017; E21B 17/012; E21B 19/002; E21B 41/0007; E21B 47/06; B63B 22/021
(Continued)

(56) References Cited

U.S. PATENT DOCUMENTS 4,052,703 A * 10/1977 Collins, Sr. ..... E21B 33/0355 714/2
7,793,725 B2 9/2010 Daniel et al.
(Continued)

FOREIGN PATENT DOCUMENTS

GB 2117714 A 10/1983
GB 2163403 A 2/1986
(Continued)

OTHER PUBLICATIONS

Shi, Ji-Quan et al. Snohvit CO2 storage project: Assessment of CO2 injection performance through history matching of the injection well pressure over a 32-months period, Energy Procedia 37 (2013) pp. 3267-3274.
(Continued)

*Primary Examiner* — Matthew Troutman
*Assistant Examiner* — Patrick F Lambe
(74) *Attorney, Agent, or Firm* — Dilworth IP, LLC

(57) ABSTRACT

A buoy accomplishes a fluid connection between a vessel on a water surface and a subsea template located on a seabed via at least one riser. A fluid is transported by the fluid connection from the vessel to the subsea template, and the fluid is injected from the subsea template (120) into a subterranean void via a drill hole. At least one valve in the buoy is controllable from an external site in response to commands so as to shut off the fluid connection from the vessel to the at least one riser.

16 Claims, 4 Drawing Sheets

(51) Int. Cl.

| | |
|---|---|
| ***E21B 17/01*** | (2006.01) |
| ***E21B 19/00*** | (2006.01) |
| ***E21B 41/00*** | (2006.01) |
| ***E21B 43/017*** | (2006.01) |
| ***E21B 47/06*** | (2012.01) |

(52) U.S. Cl.
CPC ..... *E21B 19/002* (2013.01); *E21B 41/0007* (2013.01); *E21B 43/017* (2013.01); *E21B 47/06* (2013.01)

(58) Field of Classification Search
USPC ..... 166/336
See application file for complete search history.

(56) References Cited

U.S. PATENT DOCUMENTS

| | | | | |
|---|---|---|---|---|
| 10,370,962 | B2 | 8/2019 | Zhang et al. | |
| 11,512,550 | B2 * | 11/2022 | Kvarme | E21B 19/16 |
| 2008/0138159 | A1 | 6/2008 | Daniel et al. | |
| 2015/0246711 | A1 * | 9/2015 | Lee | B63B 21/50 405/224 |
| 2018/0148147 | A1 * | 5/2018 | Wigant | B63C 11/52 |
| 2018/0252065 | A1 * | 9/2018 | Hemphill | H04B 1/745 |
| 2019/0162336 | A1 * | 5/2019 | Andersen | G01L 1/242 |

FOREIGN PATENT DOCUMENTS

| | | | |
|---|---|---|---|
| NO | 320013 | B1 | 10/2005 |
| WO | 9324731 | A1 | 12/1993 |
| WO | 2016111408 | A1 | 7/2016 |
| WO | 2018019346 | A1 | 2/2018 |

OTHER PUBLICATIONS

Eiken, O et al., Lessons Learned from 14 years of CCS Operations: Sleipner, In Salah and Snohvit, Energy Procedia 4 (2011) pp. 5541-5548.

Haugen, H et al., Commercial capture and transport of CO2 from production of ammonia, Energy Procedia 114 (2017), pp. 6133-6140.

International Search Report in International Patent Application No. PCT/EP2022/055218 dated Jun. 20, 2022.

Norwegian Search Report in NO Patent Application No. 20210292 dated Sep. 3, 2021.

* cited by examiner

BUOY FOR INJECTING FLUID IN A SUBTERRANEAN VOID AND METHODS FOR CONNECTING AND DISCONNECTING A FLUID PASSAGE FROM A VESSEL TO THE BUOY

TECHNICAL FIELD

The present invention relates generally to strategies for reducing the amount of environmentally unfriendly gaseous components in the atmosphere. Especially, the invention relates to a buoy configured to accomplish a fluid connection from a vessel on the water surface to a subsea template on the seabed, such that fluids can be transported for long term storage into a subterranean void under the seabed via said fluid connection. The invention also relates to a method for disconnecting the fluid connection between the vessel and the buoy.

BACKGROUND

Carbon dioxide is an important heat-trapping gas, a so-called greenhouse gas, which is released through certain human activities such as deforestation and burning fossil fuels. However, also natural processes, such as respiration and volcanic eruptions generate carbon dioxide.

Today's rapidly increasing concentration of carbon dioxide, $CO_2$, in the Earth's atmosphere is problem that cannot be ignored. Over the last 20 years, the average concentration of carbon dioxide in the atmosphere has increased by 11 percent; and since the beginning of the Industrial Age, the increase is 47 percent. This is more than what had happened naturally over a 20000 year period—from the Last Glacial Maximum to 1850.

Various technologies exist to reduce the amount of carbon dioxide produced by human activities, such as renewable energy production. There are also technical solutions for capturing carbon dioxide from the atmosphere and storing it on a long term/permanent basis in subterranean reservoirs.

For practical reasons, most of these reservoirs are located under mainland areas, for example in the U.S.A. and in Algeria, where the In Salah CCS (carbon dioxide capture and storage system) was located. However, there are also a few examples of offshore injection sites, represented by the Sleipner and Snøhvit sites in the North Sea. At the Sleipner site, $CO_2$ is injected from a bottom fixed platform. At the Snøhvit site, $CO_2$ from LNG (Liquefied natural gas) production is transported through a 153 km long 8 inch pipeline on the seabed and is injected from a subsea template into the subsurface below a water bearing reservoir zone as described inter alia in Shi, J-Q, et al., "Snøhvit $CO_2$ storage project: Assessment of $CO_2$ injection performance through history matching of the injection well pressure over a 32-months period", Energy Procedia 37 (2013) 3267-3274. The article, Eiken, O., et al., "Lessons Learned from 14 years of CCS Operations: Sleipner, In Salah and Snøhvit", Energy Procedia 4 (2011) 5541-5548 gives an overview of the experience gained from three $CO_2$ injection sites: Sleipner (14 years of injection), In Salah (6 years of injection) and Snøhvit (2 years of injection).

The Snøhvit site is characterized by having the utilities for the subsea $CO_2$ wells and template onshore. This means that for example the chemicals, the hydraulic fluid, the power source and all the controls and safety systems are located remote from the place where $CO_2$ is injected. This may be convenient in many ways. However, the utilities and power must be transported to the seabed location via long pipelines and high voltage power cables respectively. The communications for the control and safety systems are provided through a fiber-optic cable. The $CO_2$ gas is pressurized onshore and transported through a pipeline directly to a well head in a subsea template on the seabed, and then fed further down the well into the reservoir. This renders the system design highly inflexible because it is very costly to relocate the injection point should the original site fail for some reason. In fact, this is what happened at the Snøhvit site, where there was an unexpected pressure build up, and a new well had to be established.

As an alternative to the remote-control implemented in the Snøhvit project, the prior art teaches that $CO_2$ may be transported to an injection site via surface ships in the form of so-called type C vessels, which are semi refrigerated vessels. Type C vessels may also be used to transport liquid petroleum gas, ammonia, and other products.

In a type C vessel, the pressure varies from 5 to 18 Barg. Due to constraints in tank design, the tank volumes are generally smaller for the higher pressure levels. The tanks used have a cold temperature as low as −55 degrees Celsius. The smaller quantities of $CO_2$ typically being transported today are held at 15 to 18 Barg and −22 to −28 degrees Celsius. Larger volumes of $CO_2$ may be transported by ship under the conditions: 6 to 7 Barg and −50 degrees Celsius, which enables use of the largest type C vessels. See e.g. Haugen, H. A., et al., "13th International Conference on Greenhouse Gas Control Technologies, GHGT-13, 14-18—November 2016, Lausanne, Switzerland Commercial capture and transport of $CO_2$ from production of ammonia", Energy Procedia 114 (2017) 6133-6140.

In the existing implementations, it is generally understood that a stand-alone offshore injection site requires a floating installation or a bottom fixed marine installation. Such installations provide utilities, power and control systems directly to the wellhead platforms or subsea wellhead installations. It is not unusual, however, that power is provided from shore via high-voltage AC cables.

The prior art displays various solutions for connecting a vessel to a subterranean aquifer, or a gas or oil reservoir, which may either be depleted or contain hydrocarbons.

US 2019/0162336 shows a flexible pipe system that includes an unbonded flexible pipe connected to a floating vessel and a sensor system with an optical fiber integrated in the unbonded flexible pipe. Interrogating equipment transmits optical signals into the fiber, receives optical signals reflected from the fiber and detects a parameter of the unbonded flexible pipe. A turret connects the flexible pipe rotationally to the floating vessel via a swivel device that provides a fluid transfer passage between the turret and the vessel. The interrogating equipment is arranged on the turret and is further configured to transfer signals indicative of the detected parameter to receiving equipment on the floating vessel. In this way, optical signals reflected from the fiber can reach the interrogating equipment without distortion in the swivel, so that parameters can be detected with sufficient quality also for floating vessels equipped with a turret mooring system.

U.S. Pat. No. 7,793,725 discloses overpressure protection systems and methods for use on a production system for transferring hydrocarbons from a well on the seafloor to a vessel floating on the surface of the sea. The production system includes a subsea well in fluid communication with a turret buoy through a production flowline and riser system. The turret buoy is capable of connecting to a swivel located on a floating vessel. The overpressure protection device is positioned upstream of the swivel, to prevent overpressure of the production swivel and downstream components located on the floating vessel. The device may include one or more shut down valves, one or more sensors, an actuator assembly, and a control processor. Each shut down valve and sensor is coupled to a production flowline. Each of the sensors is capable of generating a signal based upon a pressure sensed within the production flow line. The actuator assembly is connected to each of the shut-down valves for operating the shut-down valves. The control processor, which may be a programmable logic controller, receives a signal from the sensors and sends a valve control signal to the actuator assembly for operating the shut-down valves in response to the received signals.

U.S. Pat. No. 10,370,962 teaches a system for monitoring a mooring line, umbilical, pipeline, or riser connected to an offshore structure including a control processor located on the offshore structure, a wireless network comprising a plurality of communication nodes positioned along the line, and a plurality of measurement devices embedded within the communication nodes. When the line is being monitored, the output of each of the measurement devices is in continuous wireless communication with the wireless network via at least one of the communication nodes positioned along the line and the wireless network is in continuous communication with the control processor.

Thus, different solutions are known for creating a fluid connection between a vessel and a subsea location, typically to extract hydrocarbons. However, there is yet no efficient, safe and reliable means of controlling an offloading process for injecting environmentally unfriendly fluids like carbon dioxide into subterranean reservoirs using a vessel-to-buoy connection.

SUMMARY

The object of the present invention is therefore to offer a solution that mitigates the above problems and offers an improved offloading of environmentally harmful fluids for long term storage in subterranean voids.

According to one aspect of the invention, the object is achieved by a buoy configured to accomplish a fluid connection, via at least one riser, from a vessel on a water surface to a subsea template located on a seabed, so as to enable transport of fluid from the vessel to the subsea template for injection of the fluid into a subterranean void via a drill hole from the subsea template to the subterranean void. The buoy contains at least one valve configured to allow or shut off a passage of fluid from the vessel to the at least one riser. The buoy also contains a primary communication interface configured to be connected to an external site and receive commands from the external site, for example in the form of optical signals transmitted via a fiber optic cable. In response to the received commands, the buoy is configured to control the at least one valve to either allow or shut off the passage of fluid from the vessel to the at least one riser.

The proposed buoy is advantageous because it requires a minimal amount of technical and local personnel resources on the vessel. This, in turn, is beneficial from an overall cost point-of-view.

According to one embodiment of this aspect of the invention, the buoy has a secondary communication interface, e.g. inductive, configured to be connected to the vessel and receive commands from the vessel. In response to the received commands, the buoy is configured to control the at least one valve to either allow or shut off the passage of fluid from the vessel to the at least one riser. Thereby, the vessel is provided with an alternative means of communication to the buoy, which vouches for redundancy and enhanced reliability.

According to another embodiment of this aspect of the invention, the at least one valve is configured to automatically shut off the passage of fluid from the vessel to the at least one riser, if a fluid-transporting conduit from the vessel is disconnected while the at least one valve is set in a position allowing the passage of fluid through the at least one valve. Thus, in case of an emergency situation or if the vessel is unexpectedly disconnected for other reasons, there is no risk that the fluid escapes into the water and/or the atmosphere.

According to yet another embodiment of this aspect of the invention, the buoy contains at least one pressure sensor configured to register a respective pressure level of the fluid in the at least one riser between the buoy and the subsea template. Preferably, the buoy further contains a control unit, which is communicatively connected to the at least one pressure sensor. The control unit is configured to control the at least one valve in response to the respective pressure level registered by the at least one pressure sensor in such a manner that a particular valve of the at least one valve is only allowed to be opened if the registered pressure level in the riser controlled by the particular valve lies within a predefined pressure range. Consequently, initiating the injection of fluid into the risers can be made very safe.

According to still another embodiment of this aspect of the invention, the buoy contains at least one swivel connector, which is configured to allow a relative rotation between a fluid-transporting output from the vessel and the at least one riser, such that a geo stationary connection is maintainable between the buoy and the at least one riser while a stationary connection is maintained between the buoy and the fluid-transporting output from the vessel irrespective of any rotation movements of the vessel relative to the at least one riser while the vessel is connected to the buoy via the fluid-transporting output. Thereby, a highly reliable vessel-to-buoy connection can be maintained during the entire offloading process.

According to another embodiment of this aspect of the invention, each of the at least one swivel connector contains at least one connection port to the fluid-transporting output from the surface vessel. Each of the at least one connection port includes a replaceable sealing surface, the position of which is variable along a frustrum-shaped connector member. Alternatively, or additionally, a position of the replaceable sealing surface may be varied on a mating connector member of the at least one connection port adapted to cooperate with the frustrum-shaped connector member. Thus, varying degrees of wear on the frustrum-shaped connector member may be handled efficiently.

Preferably, the at least one valve is arranged downstream of the at least one swivel connector with respect to a flow direction of the fluid output from the vessel.

According to yet another embodiment of this aspect of the invention, the buoy contains a battery configured to provide electric power for operating the at least one valve. Preferably, the power interface is configured to receive electric power from an external site, and the battery is arranged to be charged by the electric power received via the power interface. Thereby, it is ensured that the at least one valve can be operated as intended also if the buoy would suffer from a temporary power outage.

According to another aspect of the invention, the object is achieved by a method for connecting a passage for a fluid from a vessel on a water surface to a subsea template located on a seabed. The connection is here effected via a buoy and at least one riser connected between the buoy and the subsea template. The subsea template is configured to inject the fluid further into a subterranean void via a drill hole. The method involves the steps:

- connecting at least one output pipe in the vessel to a respective at least one swivel connector in the buoy;
- measuring at least one respective pressure level in each of the at least one riser;
- determining, based on the at least one respective pressure level in each of the at least one riser, a respective equalization pressure for each of the at least one riser;
- pressurizing each of the at least one output pipe in the vessel to the respective equalization pressure; and thereafter
- opening at least one valve in the buoy to each of the at least one riser; and thereafter
- opening at least one valve in the subsea template to each of the at least one riser.

This method is advantageous because it minimizes the risk of fluid leakage in the vessel-to-template connection.

According to yet another aspect of the invention, the object is achieved by a method for disconnecting a passage for a fluid from a vessel on a water surface to a subsea template located on a seabed. The template is configured to inject the fluid further into a subterranean void via a drill hole. Also here, the vessel is in fluid connection with the template by means of a buoy and at least one interconnecting riser. The method involves the steps:

- while the fluid is being passed from the vessel into the subterranean void, injecting at least one assisting liquid into each of the at least one riser;
- shutting off the passage of fluid from the vessel to the at least one riser by closing a respective at least one valve in the buoy;
- measuring a pressure level in each of the at least one riser;
- continuing to inject the fluid into the subterranean void via the at least one riser until the pressure level in each of the at least one riser has reached an equalization level; and after that the pressure level in each of the at least one riser has reached the equalization level
- closing a respective at least one valve in the template to each of the at least one riser.

This method is advantageous because it minimizes the risk of fluid leakage when the vessel is disconnected from the buoy.

Further advantages, beneficial features and applications of the present invention will be apparent from the following description and the dependent claims.

BRIEF DESCRIPTION OF THE DRAWINGS

The invention is now to be explained more closely by means of preferred embodiments, which are disclosed as examples, and with reference to the attached drawings.

DETAILED DESCRIPTION

Figure 1:
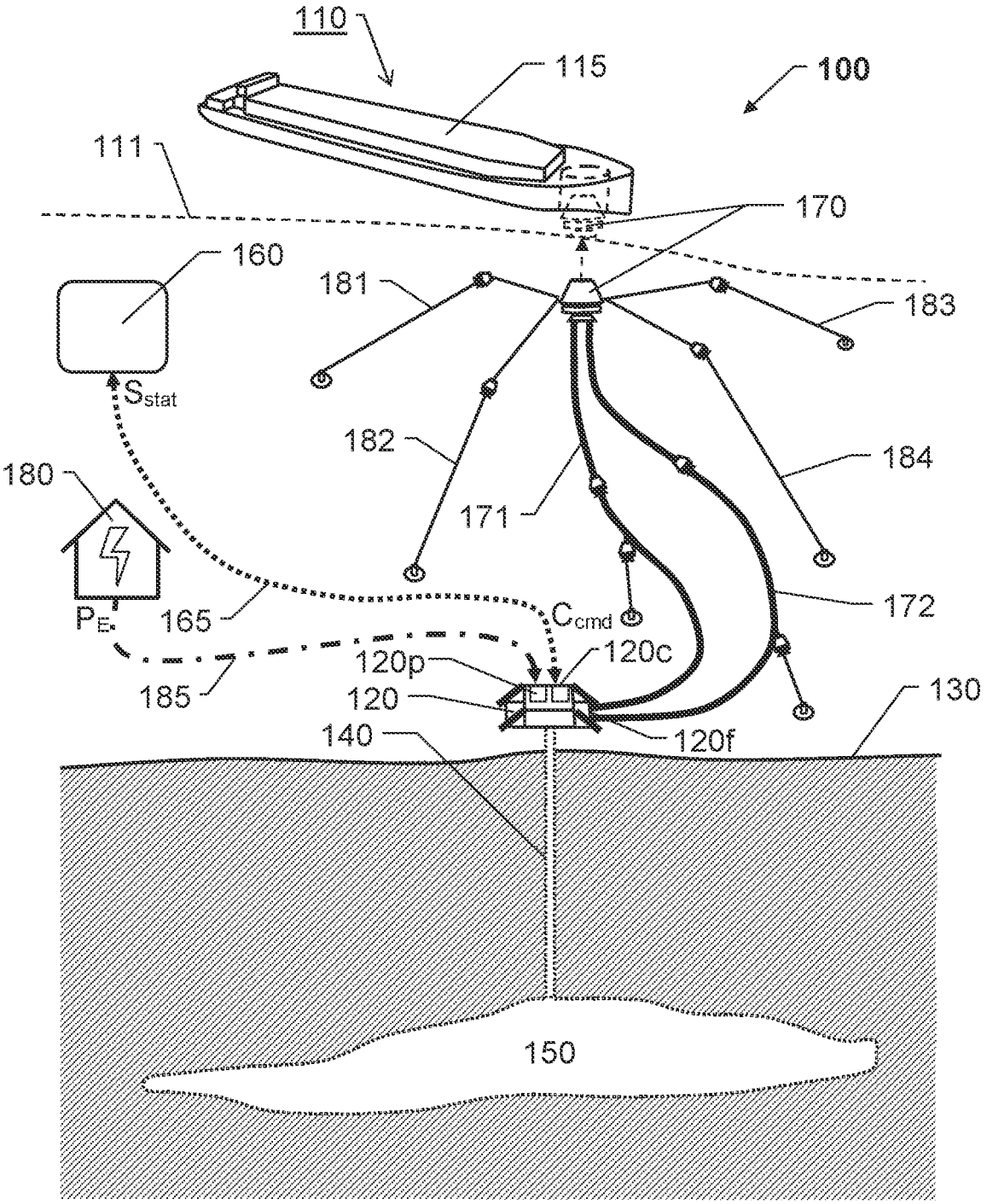
FIG. 1 schematically illustrates a system for long term storage of fluids in a subterranean void according to one embodiment of the invention.

In FIG. 1, we see a schematic illustration of a system according to one embodiment of the invention for long term storage of fluids, e.g. carbon dioxide, in a subterranean void or other accommodation space 150, which typically is a subterranean aquifer. However, according to the invention, the subterranean void 150 may equally well be a reservoir containing gas and/or oil, a depleted gas and/or oil reservoir, a carbon dioxide storage/disposal reservoir, or a combination thereof. These subterranean accommodation spaces are typically located in porous or fractured rock formations, which for example may be sandstones, carbonates, or fractured shales, igneous or metamorphic rocks.

The system includes at least one offshore injection site 100, which is configured to receive fluid, e.g. in a liquid phase, from at least one fluid tank 115 of a vessel 110. The offshore injection site 100, in turn, contains a subsea template 120 arranged on a seabed/sea bottom 130. The subsea template 120 is located at a wellhead for a drill hole 140 to the subterranean void 150. The subsea template 140 also contains a utility system configured to cause the fluid from the vessel 110 to be injected into the subterranean void 150 in response to control commands $C_{cmd}$. In other words, the utility system is not located onshore, which is advantageous for logistic reasons. For example therefore, in contrast to the above-mentioned Snøhvit site, there is no need for any umbilicals or similar kinds of conduits to provide supplies to the utility system.

The utility system in the subsea template 120 may contain at least one storage tank. The at least one storage tank holds at least one assisting liquid, which is configured to facilitate at least one function associated with injecting the fluid into the subterranean void 150. The at least one assisting liquid contains a de-hydrating liquid and/or an anti-freezing liquid.

In particular, the at least one storage tank may hold Monoethylene Glycol (MEG). The MEG may be heated in the subsea template 120, and be injected into the subterranean void 150 prior to injecting the fluid, for instance in the form of $CO_2$ in the liquid phase. The heated MEG removes any $CO_2$ hydrates in at least one injection riser 171 and 172 connecting the subsea template 120 to a buoy 170, which buoy 170 and risers 171 and 172 are configured to transport the fluid from the vessel 110 to the subsea template 120. Formation of $CO_2$ hydrates is detrimental because it can lead to blockages in the risers, which, in turn cause overpressure therein. Eventually the risers may burst, and $CO_2$ will leak into the sea. This has negative environmental effects, leads to replacement cost and forces an interruption in the operation of the injection site 100.

Additionally, MEG held in the at least one storage tank may be used in the subsea template 120 for valve testing, injecting MEG over a valve when starting up after a shutdown and/or flushing.

The injection, e.g. of $CO_2$, vaporizes formation water which typically surrounds the subsea template 120 and its wellhead into the dry $CO_2$, especially near the injection wellbore. This increases formation water salinity locally, leading to supersaturation and subsequent salt precipitation. The process is aggravated by capillary and, in some cases, gravity backflow of brine into the dried zone. The accumulated precipitated salt reduces permeability around the injection well, and may cause unacceptably high injection pressures, and consequently reduced injection. The effect depends on formation water salinity and composition, and formation permeability. A MEG injection system of the subsea template 120 preferably contains a storage tank, an accumulator tank an at least one chemical pump.

The above is an issue particularly for an early injection period, before establishing a significant $CO_2$ plume around the injection well, when formation water backflow during injection stops (it) is more likely to occur.

In FIG. 1, a control site, generically identified as 160, is adapted to generate the control commands $C_{cmd}$ for controlling the flow of fluid from the vessel 110 and down into the subterranean void 150. For example, the control commands $C_{cmd}$ may relate to opening and closure of valves when the vessel 110 connects to and disconnects from the buoy 170. The control site 160 is positioned at a location geographically separated from the offshore injection site 100, for example in a control room onshore. However, additionally or alternatively, the control site 160 may be positioned at an offshore location geographically separated from the offshore injection site, for example at another offshore injection site. Consequently, a single control site 160 can control multiple offshore injection sites 100. There is also large room for varying which control site 160 controls which offshore injection site 100. Communications and controls are thus located remote from the offshore injection site 100. However, as will be discussed below, the offshore injection site 100 may be powered locally, remotely or both.

In order to enable remote control from the control site 160, the subsea template 120 contains a communication interface 120*c* that is communicatively connected to the control site 160. The subsea template 120 is also configured to receive the control commands $C_{cmd}$ via the communication interface 120*c*.

Depending on the channel(s) used for forwarding the control commands $C_{cmd}$ between the control site 160 and the offshore injection site 100, the communication interface 120*c* may be configured to receive the control commands $C_{cmd}$ via a submerged fiber-optic and/or copper cable 165, a terrestrial radio link (not shown) and/or a satellite link (not shown). In the latter two cases, the communication interface 120*c* includes at least one antenna arranged above the water surface 111.

Preferably, the communicative connection between the control site 160 and the subsea template 120 is bi-directional, so that for example acknowledge messages $C_{ack}$ may be returned to the control site 160 from the subsea template 120.

According to the invention, the offshore injection site 100 includes a buoy 170, for instance of submerged turret loading (STL) type. When inactive, the buoy 170 may be submerged to 30-50 meters depth, and when the vessel 110 approaches the offshore injection site 100 to offload fluid, the buoy 170 and at least one injection riser 171 and 172 connected thereto are elevated to the water surface 111. After that the vessel 110 has been positioned over the buoy 170, this unit is configured to be connected to the vessel 110 and receive the fluid from the vessel's fluid tank(s) 115, for example via a swivel assembly in the buoy 170. The buoy 170 is preferably anchored to the seabed 130 via one or more hold-back clamps 181, 182, 183 and 184, which enable the buoy 170 to elevated and lowered in the water.

Each of the injection risers 171 and 172 respectively is configured to forward the fluid from the buoy 170 to the subsea template 120, which, in turn, is configured to pass the fluid on via the wellhead and the drill hole 140 down to the subterranean void 150.

According to one embodiment of the invention, the subsea template 120 contains a power input interface 120*p*, which is configured to receive electric energy PE for operating the utility system and/or operating various functions in the buoy 170. The power input interface 120*p* may be also configured to receive the electric energy PE to be used in connection with operating a well at the wellhead, a safety barrier element of the subsea template 120 and/or a remotely operated vehicle (ROV) stationed on the seabed 130 at the subsea template 120.

FIG. 1 illustrates a generic power source 180, which is configured to supply the electric power PE to the power input interface 120*p*. It is generally advantageous if the electric power PE is supplied via a cable 185 from the power source 180 in the form of low-power direct current (DC) in the range of 200V-1000V, preferably around 400V. The power source 180 may either be co-located with the offshore injection site 100, for instance as a wind turbine, a solar panel and/or a wave energy converter; and/or be positioned at an onshore site and/or at another offshore site geographically separated from the offshore injection site 100. Thus, there is a good potential for flexibility and redundancy with respect to the energy supply for the offshore injection site 100.

The subsea template 120 contains a valve system that is configured to control the injection of the fluid into the subterranean void 150. The valve system, as such, may be operated by hydraulic means, electric means or a combination thereof. The subsea template 120 preferably also includes at least one battery configured to store electric energy for use by the valve system as a backup to the electric energy PE received directly via the power input interface 120*p*. More precisely, if the valve system is hydraulically operated, the subsea template 120 contains a hydraulic pressure unit (HPU) configured to supply pressurized hydraulic fluid for operation of the valve system. For example, the HPU may supply the pressurized hydraulic fluid through a hydraulic small-bore piping system. The at least one battery is here configured to store electric backup energy for use by the hydraulic power unit and the valve system.

Alternatively, or additionally, the valve operations may also be operated using an electrical wiring system and electrically controlled valve actuators. In such a case, the subsea template 120 contains an electrical wiring system configured to operate the valve system by means of electrical control signals. Here, the at least one battery is configured to store electric backup energy for use by the electrical wiring system and the valve system.

Consequently, the valve system may be operated also if there is a temporary outage in the electric power supply to the offshore injection site. This, in turn, increases the overall reliability of the system.

Locating the utility system at the subsea template 120 in combination with the proposed remote control from the control site 160 avoids the need for offshore floating installations as well as permanent offshore marine installations. The invention allows direct injection from relatively uncomplicated maritime vessels 110. These factors render the system according to the invention very cost efficient.

According to the invention, further cost savings can be made by avoiding the complex offshore legislation and regulations. Namely, a permanent offshore installation acting as a field center for an offshore field development is bound by offshore legislation and regulations. There are strict safety requirements related to well control especially. For instance, offshore Norway, it is stipulated that floating offshore installations, permanent or temporary, that control well barriers must satisfy the dynamic positioning level 3 (DP3) requirement. This involves extensive requirements in to ensure that the floater remains in position also during extreme events like engine room fires, etc. Nevertheless, the vessel 110 according to the invention does not need to provide any utilities, well or barrier control, for the injection system. Consequently, the vessel 110 may operate under maritime legislation and regulations, which are normally far less restrictive than the offshore legislation and regulations.

Figure 2:
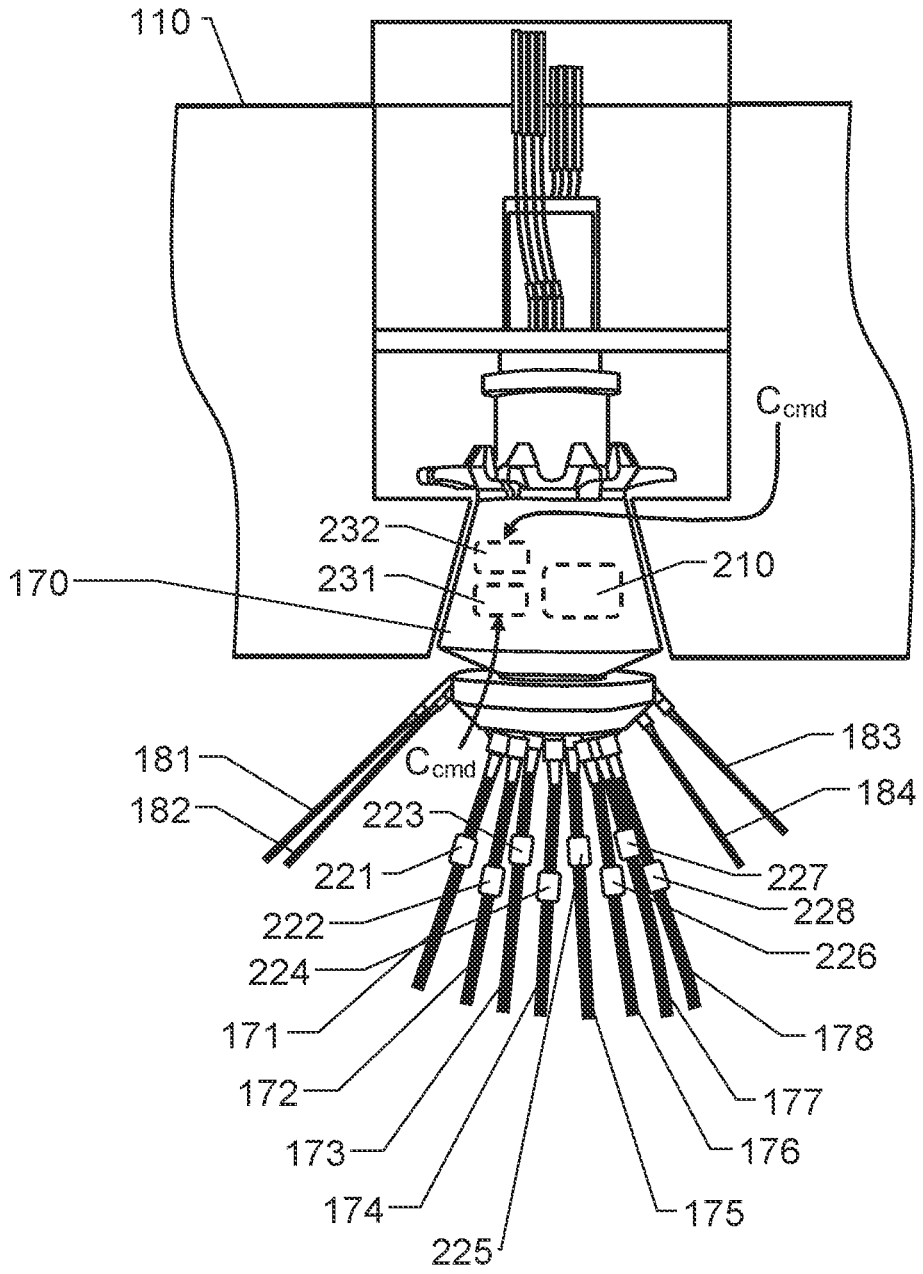
FIG. 2 shows a buoy being connected to a vessel according to one embodiment of the invention.

FIG. 2 shows a buoy 170, which is connected to a vessel 110 according to one embodiment of the invention.

The buoy 170 has at least one pressure sensor, here represented by 221, 222, 223, 224, 225, 226, 227 and 228 arranged in an upper section of a respective riser 171, 172, 173, 174, 175, 176, 177 and 178 connected between the buoy 170 and the subsea template 120 on the seabed 130. The pressure sensors 221, 222, 223, 224, 225, 226, 227 and 228 are configured to register a respective pressure level of the fluid F in the riser 171, 172, 173, 174, 175, 176, 177 and 178 respectively. Preferably, the buoy 170 contains a control unit 210 that is communicatively connected to each of the at least one pressure sensor 221, 222, 223, 224, 225, 226, 227 and 228, for example via a bus cable or a set of individual lines to each respective pressure sensor.

Figure 5:
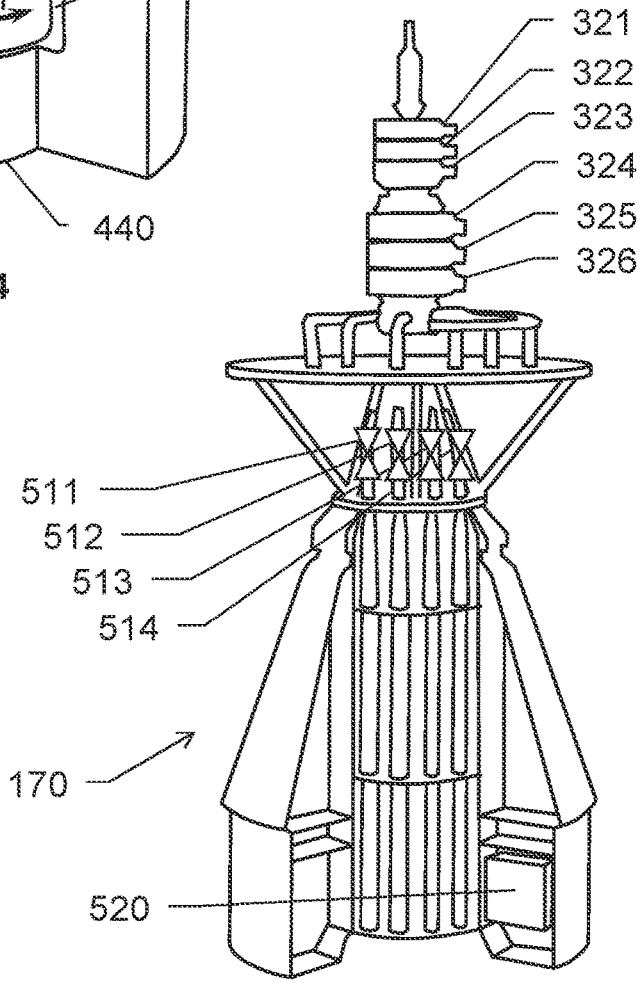
FIG. 5 illustrates how swivel connectors and valves may be arranged on the buoy according to one embodiment of the invention.

Referring now to FIG. 5, we see a buoy 170 with a set of swivel connectors 321, 322, 323, 324, 325 and 326. Preferably, the number of swivel connectors is equal to the number of risers connected to the buoy 170. Thus, if for example, there are eight risers interconnecting the buoy 170 and the subsea template 120, it is advantageous if the buoy 170 also has eight swivel connectors. It is further preferable if the buoy 170 contains one valve for each riser and each swivel connector. For reasons of clarity, however, FIG. 5 only shows four valves 511, 512, 513 and 514 respectively and six of swivel connectors 321, 322, 323, 324, 325 and 326 even though eight risers 171, 172, 173, 174, 175, 176, 177 and 178 are illustrated.

The control unit 210 is configured to control each of the valves 511, 512, 513 and 514 in response to the respective pressure level registered by the pressure sensors 221, 222, 223, 224, 225, 226, 227 and 228 in such a manner that a particular valve is only allowed to be opened if the registered pressure level in the supervised riser being controlled by the particular valve lies within a predefined pressure range.

In FIG. 2, the buoy 170 is in fluid connection with the subsea template 120 located on the seabed 130 via each of the risers 171, 172, 173, 174, 175, 176, 177 and 178. The buoy 170 is further in fluid connection with the vessel 110 on the water surface 111. Thereby, fluid F may be transported from the vessel 110 to the subsea template 120 for injection of the fluid F into the subterranean void 150 via the drill hole 140 from the subsea template 120 to the subterranean void 150. The buoy 170 contains at least one valve, for example as illustrated by 511, 512, 513 and 514 in FIG. 5, each of which valve is configured to allow or shut off a passage of fluid F from the vessel 110 to the at least one riser 171, 172, 173, 174, 175, 176, 177 and 178.

The buoy 170 has a primary communication interface 231, which is configured to be connected to an external site 160, for example as shown in FIG. 1. The primary communication interface 231 is configured to receive commands $C_{cmd}$ from the external site 160. In response to the received commands $C_{cmd}$, the buoy 170 is configured to control the valves 511, 512, 513, and 514 to either allow or shut off the passage of fluid F from the vessel 170 to each of the risers 171, 172, 173, 174, 175, 176, 177 and 178. In FIG. 2, the hold-back clamps 181, 182, 183 and 184 for the buoy 170 are also shown.

According to one embodiment of the invention, the primary communication interface 231 is configured to receive the communication commands $C_{cmd}$ in the form of optical signals transmitted via a fiber optic cable from the external site 160.

According to another embodiment of the invention, the buoy 170 also has a secondary communication interface 232, which is configured to be connected to the vessel 110. The secondary communication interface 232 is configured to receive commands $C_{cmd}$ from the vessel 110. Analogously, in response to the received commands $C_{cmd}$, the buoy 170 is configured to control the valves 511, 512, 513 and 514 to either allow or shut off the passage of fluid F from the vessel 110 to the at least one riser 171, 172, 173, 174, 175, 176, 177 and 178. Consequently, the secondary communication interface 232 provides an alternative and parallel means of controlling the valves 511, 512, 513 and 514 in the buoy 170.

As a safety measure, each of the valves 511, 512, 513 and 514 is preferably configured to automatically shut off the passage of fluid F from the vessel 110 to the risers 171, 172, 173, 174, 175, 176, 177 and 178 if a fluid-transporting conduit from the vessel 110 is disconnected while at least one of the valves 511, 512, 513 and/or 514 is set in a position allowing the passage of fluid F through the valve.

Preferably, the valves 511, 512, 513 and 514 are arranged downstream of the swivel connectors 321, 322, 323, 324, 325 and 326 with respect to a flow direction of the fluid F output from the vessel 110. Namely, this renders it possible to efficiently cutoff the fluid flow on the buoy side whenever needed.

According to one embodiment of the invention, the buoy 170 contains at least one battery 520, which is configured to provide electric power for operating the valves 511, 512, 513 and 514. Thereby, operation of the valves can be ensured also if an external energy supply to the buoy 170 is broken, for example from an onshore power source 180 providing electric power PE via a power line 185.

It is further advantageous if the buoy 170 contains a power interface 240 configured to receive electric power PE from an external site, e.g. as illustrated in FIG. 1. The battery 520 is further arranged to be charged by the electric power PE, which is received via the power interface 240. This arrangement is beneficial because it reduces the risk that the battery 520 becomes discharged.

Figure 3:
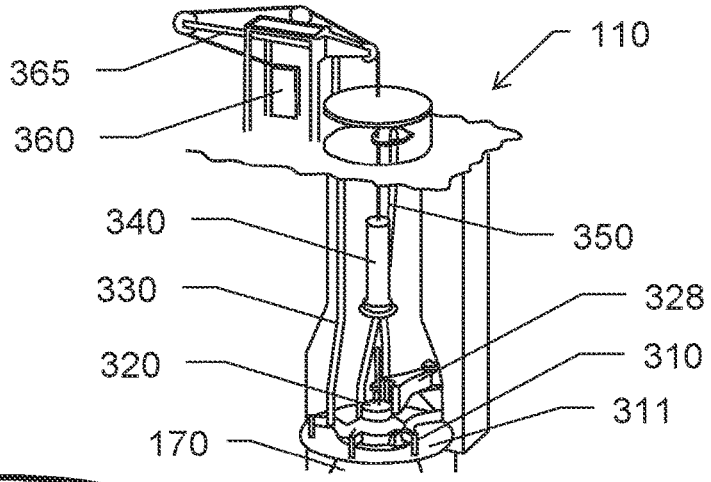
FIG. 3 shows details of how the buoy is connected to the vessel according to one embodiment of the invention.

FIG. 3 shows details of how the buoy 170 is connected to the vessel 110 according to one embodiment of the invention. Here, buoy locking devices 310 secure the buoy 170 to a platform 311 in the vessel 110. A swivel handling arm 328 is configured to handle at least one swivel connector 320 of the buoy 170. A rope guide 340 is configured to steer various conduits and pipes to the buoy 170. A traction winch 360 and a heave compensator 365 are arranged to assist in connecting the conduits and pipes to the buoy 170. Preferably, a ventilation duct 330 reaches down to the buoy 170, so that any gaseous fluids can be led away in a convenient manner.

Figure 4:
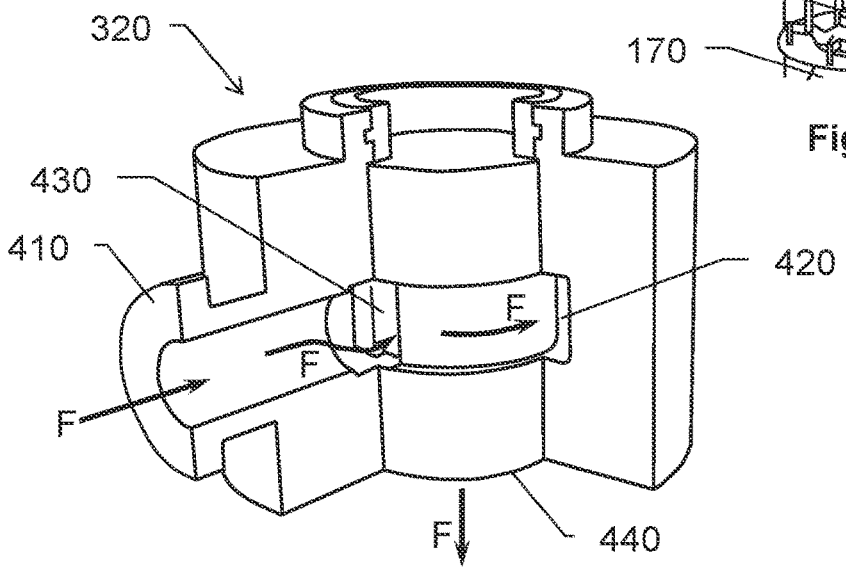
FIG. 4 shows a swivel connector according to one embodiment of the invention.

FIG. 4 shows the swivel connector 320 according to one embodiment of the invention in somewhat further detail. Here, a first pipe connector 410 is configured to be connected to a fluid-transporting output from the vessel 110. A second pipe connector 440 is configured to be connected to the buoy 170, and further to at least one and of the risers 171, 172, 173, 174, 175, 176, 177 and 178. The swivel connector 320 is configured to allow a relative rotation between the fluid-transporting output from the vessel 110 and said at least one riser. In other words, the first pipe connector 410 may be rotated freely in relation to the second pipe connector 440. Specifically, this rotation is possible while the fluid F flows around a circumference 420 of an interior member in the swivel connector 320 and enters into a cavity 430 connected to the second pipe connector 440 as illustrated by the arrows. Consequently, it is possible to maintain a geo stationary connection between the buoy 170 and the risers 171, 172, 173, 174, 175, 176, 177 and 178; and at the same time, allow arbitrary rotation movements of the fluid-transporting output from the vessel 110 irrespective of any rotation movements of the relative to the risers while the vessel 110 is connected to the buoy 170 via the fluid-transporting output.

Figure 6:
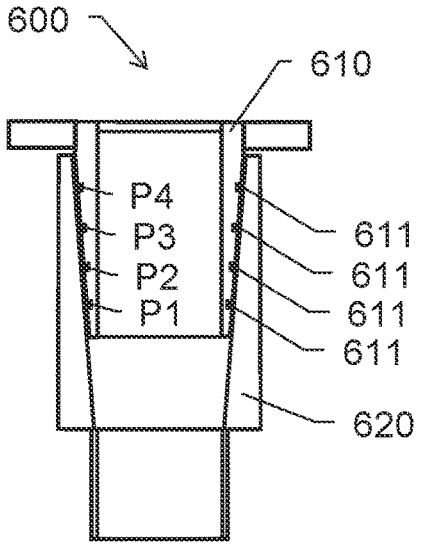
FIG. 6 illustrates a replaceable sealing surface of a connection port according to one embodiment of the invention.

FIG. 6 illustrates a replaceable sealing surface 611 of a connection port 600 according to one embodiment of the invention. In this embodiment, each of the above-described swivel connectors 320, 321, 322, 323, 324, 325 and 326 contains the connection port 600, which is configured to be connected to the fluid-transporting output from the vessel 110.

The connection port 600 has a replaceable sealing surface 611 whose position is variable along a frustrum-shaped connector member 610 of the connection port 600. FIG. 6 illustrates four different positions P1, P2, P3 and P4 respectively at which the replaceable sealing surface 611 can be arranged to seal the frustrum-shaped connector member 610 to a mating connector member 620 of the connection port 600, which mating connector member 620 has an inverted frustrum-shape configured to cooperate with the frustrum-shaped connector member 610. The positions P1, P2, P3 and P4 may be located on the frustrum-shaped connector member 610 and/or on the mating connector member 620. In any case, the different positions P1, P2, P3 and P4 make it possible to adjust for varying degrees of wear on the frustrum-shaped connector member 610 and/or on the mating connector member 620. Thus, as the connection port 600 is worn down, the sealing surface 611 may gradually be moved from one of the positions P1, P2, P3 and P4 to another.

Figure 7:
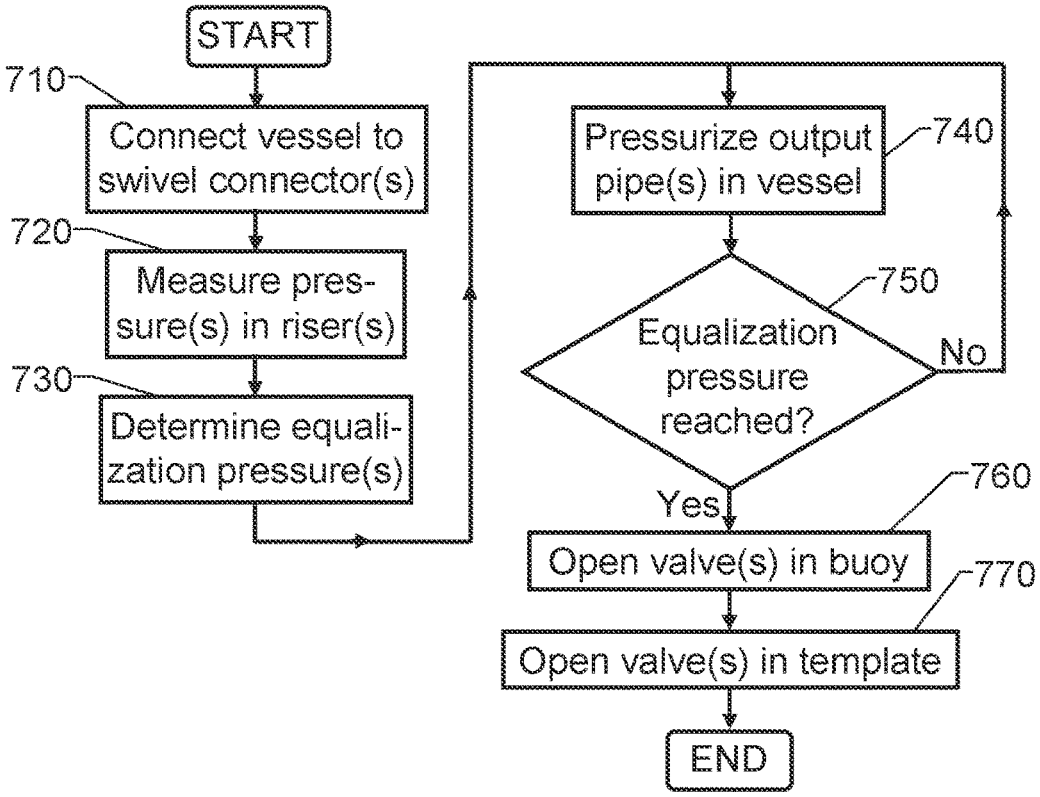
FIGS. 7-8 illustrate, by means of flow diagrams, embodiments of methods according to the invention for connecting and disconnecting respectively a vessel to/from a buoy.
Figure 8:
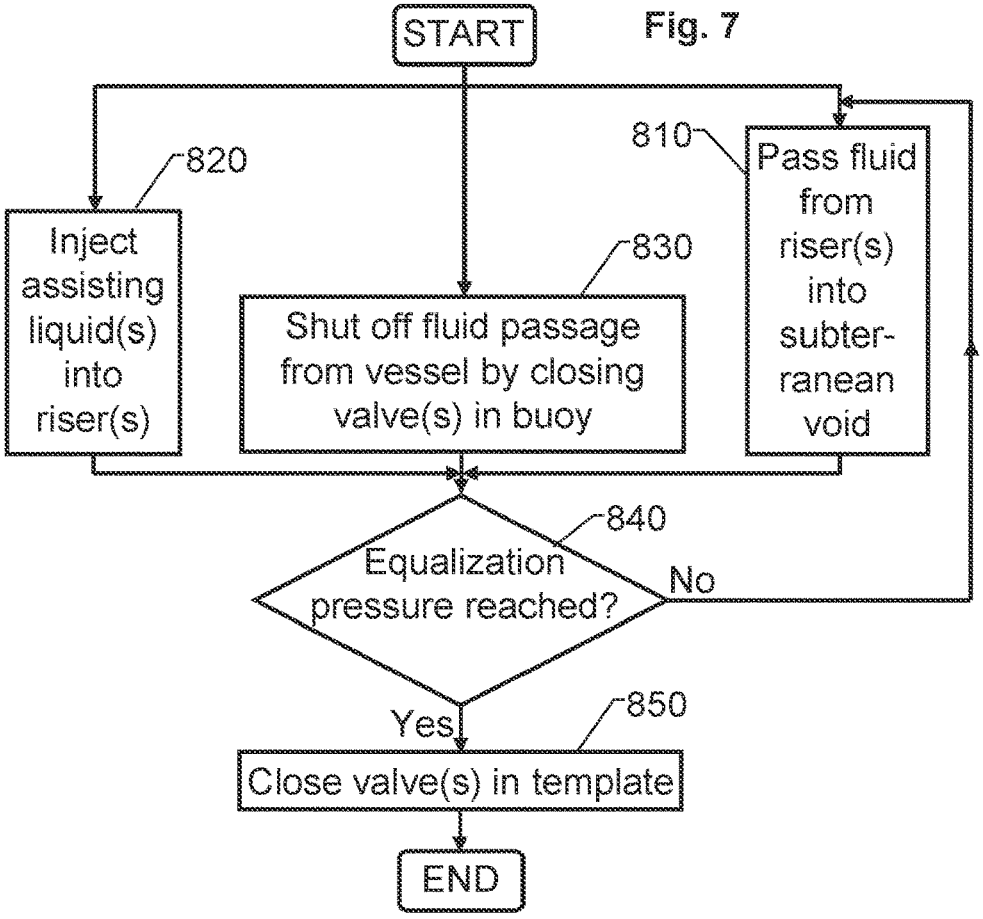

Now, with reference to the flow diagrams in FIGS. 7 and 8, we will describe methods according to embodiments of the invention for connecting and disconnecting the vessel 110 to and from the buoy 170 respectively in order to discharge a fluid F, for example containing $CO_2$, into a subterranean void 150. Both methods presume that the buoy 170 is connected to a subsea template 120 located on a seabed 130 via a at least one riser, e.g. 171 and 172, between the buoy 170 and the subsea template 120; and that the subsea template 120 is configured to inject the fluid F further into the subterranean void 150 via the drill hole 140.

In FIG. 7, in a first step 710, at least one output pipe in the vessel 110 is connected at least to at least one respective swivel connector, such as 321, 322, 323, 324, 325 and 326 in the buoy 170.

In a subsequent step 720, at least one respective pressure level is measured in each of the risers. Thereafter, in a step 730, a respective equalization pressure is determined based on the at least one respective pressure level in the risers. For example, a first respective pressure level may be measured in an upper section of each riser—near the buoy, and a second respective pressure level may be measured in an lower section of each riser—near the subsea template 120. The respective equalization pressure for each of the at least one riser may then be determined as an average value of the first and second respective pressure levels.

After that, in a step 740, each of the at least one output pipe in the vessel 110 is pressurized to the respective equalization pressure determined in step 730. A step 750 thereafter checks if the equalization pressure has been reached. If so, a step 760 follows; and otherwise, the procedure loops back and stays in step 750. This adapts the vessel's pressure level to that of the risers, and minimizes the risk of undesired pressure transients when opening the valves between the vessel and the buoy.

In step 760, at least one valve, e.g. 511, 512, 513 and 514 in the buoy 170 to the risers is opened so that the fluid may pass out from the vessel and into the risers.

Finally, in a step 770, at least one valve in the subsea template 120 is opened to each of the risers. Thus, the fluid F may be injected into the subterranean void 150, and the procedure ends.

The procedure described with reference to FIG. 8 continues where the above-described procedure ended. This means that, in a first step 810, the fluid F is being passed from the at least one riser and into the subterranean void 150. Indeed, is further presumed that the fluid F enters the risers from the vessel 110.

While the fluid F is being passed from the vessel 110 and further down into the subterranean void 150, in a step 820 parallel to step 810, at least one assisting liquid injecting into each of the risers. The assisting liquid may be represented by heated chemicals that for example are stored in the vessel 110 and/or in the subsea template 120. The at least one assisting liquid may be adapted to maintain $CO_2$ in a liquid phase in the risers. This is important for several reasons, for example to maintain a stable density of the fluid F in the risers, to reduce fatigue loads therein, and thus extend their expected lifetime. Maintaining liquid-phase $CO_2$ and thus pressure in the risers is important for preserving a high water solubility in the $CO_2$ and thus avoid free water in the riser. Namely, free water may here lead to the creation of $CO_2$ hydrates, which, in turn, may lead to the occurrence of slug flow in the risers as well as any fatigue loads resulting there from. The at least one assisting liquid may contain MEG, Diethylene Glycol (DEG) and/or Triethylene Glycol (TEG).

After having injected the at least one assisting liquid, and while the fluid F continues to be passed into the subterranean void 150, in a step 830, the passage of fluid F from the vessel 110 to the risers is shut off by closing a respective at least one valve, e.g. 511, 512, 513 and 514 in the buoy 170. For instance, the at least one valve may be closed in response to commands $C_{cmd}$ received in the buoy 170 from an external site 160.

It is further advantageous that the at least one valve 511, 512, 513 and/or 514 is closed automatically if the buoy 170 becomes disconnected—unintentionally—from the vessel 110 while the fluid F is being passed out from the vessel 110 and into the risers. Namely, otherwise, personnel on the vessel 110 might become injured and/or environmental issues may occur.

A respective pressure level in each of the risers is measured while the fluid F from the risers continues to be injected into the subterranean void 150 via the subsea template 120. During this process, the pressure level in each of the risers is measured; and in a step 840, it is checked if the pressure level has reached an equalization level. If so, a step 850 follows; and otherwise, the procedure loops back and stays in step 840.

In step 850, a respective valve in the subsea template 120 to each of the risers is closed. Thereafter the procedure ends.

Preferably, the at least one valve in the subsea template 120 is closed automatically in response the pressure level in the respective riser having reached the equalization level.

Variations to the disclosed embodiments can be understood and effected by those skilled in the art in practicing the claimed invention, from a study of the drawings, the disclosure, and the appended claims.

The term "comprises/comprising" when used in this specification is taken to specify the presence of stated features, integers, steps or components. The term does not preclude the presence or addition of one or more additional elements, features, integers, steps or components or groups thereof. The indefinite article "a" or "an" does not exclude a plurality. In the claims, the word "or" is not to be interpreted as an exclusive or (sometimes referred to as "XOR"). On the contrary, expressions such as "A or B" covers all the cases "A and not B", "B and not A" and "A and B", unless otherwise indicated. The mere fact that certain measures are recited in mutually different dependent claims does not indicate that a combination of these measures cannot be used to advantage. Any reference signs in the claims should not be construed as limiting the scope.

It is also to be noted that features from the various embodiments described herein may freely be combined, unless it is explicitly stated that such a combination would be unsuitable.

The invention is not restricted to the described embodiments in the figures, but may be varied freely within the scope of the claims.

The invention claimed is:

1. A buoy configured to accomplish a fluid connection, via at least one riser, from a vessel on a water surface to a subsea template located on a seabed, so as to enable transport of fluid from the vessel to the subsea template for injection of the fluid into a subterranean void via a drill hole from the subsea template to the subterranean void, the buoy comprising:

at least one valve configured to allow or shut off a passage of fluid from the vessel to the at least one riser, wherein the buoy comprises a primary communication interface configured to:

be connected to an external site positioned at a location being geographically separated from an offshore injection site containing the subsea template and from the vessel, and receive commands from the external site, wherein in response to the received commands, the buoy is configured to, by electrical operation, control the at least one valve to either allow or shut off the passage of fluid from the vessel to the at least one riser.

2. The buoy according to claim 1, wherein the primary communication interface is configured to receive the communication commands in the form of optical signals transmitted via a fiber optic cable from the external site.

3. The buoy according to claim 1, comprising a secondary communication interface configured to:

be connected to the vessel, receive commands from the vessel, and wherein in response to the received commands, the buoy is configured to control the at least one valve to either allow or shut off the passage of fluid from the vessel to the at least one riser.

4. The buoy according to claim 1, wherein the at least one valve is configured to automatically shut off the passage of fluid from the vessel to the at least one riser if a fluid-transporting conduit from the vessel is disconnected while the at least one valve is set in a position allowing the passage of fluid through the at least one valve.

5. The buoy according to claim 4, comprising at least one pressure sensor configured to register a respective pressure level of the fluid in the at least one riser between the buoy and the subsea template.

6. The buoy according to claim 5, comprising a control unit communicatively connected to the at least one pressure sensor, and the control unit is configured to control the at least one valve in response to the respective pressure level registered by the at least one pressure sensor in such a manner that a particular valve of the at least one valve is only allowed to be opened if the registered pressure level in the riser controlled by the particular valve lies within a predefined pressure range.

7. The buoy according to claim 5, comprising at least one swivel connector configured to allow a relative rotation between a fluid-transporting output from the vessel and the at least one riser, such that a geo stationary connection is maintainable between the buoy and the at least one riser while a stationary connection is maintained between the buoy and the fluid-transporting output from the vessel irrespective of any rotation movements of the vessel-relative to the at least one riser while the vessel is connected to the buoy via the fluid-transporting output.

8. The buoy according to claim 7, wherein the at least one valve is arranged downstream of the at least one swivel connector with respect to a flow direction of the fluid output from the vessel.

9. The buoy according to claim 1, wherein each of the at least one swivel connector comprises at least one connection port to the fluid-transporting output from the vessel, which at least one connection port comprises a replaceable sealing surface, the position of which is variable along a frustrum-shaped connector member to adjust for varying degrees of wear on the frustrum-shaped connector member and/or on a mating connector member of at least one connection port cooperating with the frustrum-shaped connector member.

10. The buoy according to claim 1, comprising a battery configured to provide electric power for operating the at least one valve.

11. The buoy according to claim 10, comprising a power interface configured to receive electric power from an external site, and the battery is arranged to be charged by the electric power received via the power interface.

12. A method for connecting a passage for a fluid from a vessel on a water surface to a subsea template located on a seabed via a buoy and at least one riser between the buoy and the subsea template, which subsea template is configured to inject the fluid further into a subterranean void via a drill hole, the method comprising:

connecting at least one output pipe in the vessel to a respective at least one swivel connector in the buoy;

measuring at least one respective pressure level in each of the at least one riser;

determining, based on the at least one respective pressure level in each of the at least one riser, a respective equalization pressure for each of the at least one riser;

pressurizing each of the at least one output pipe in the vessel to said respective equalization pressure; and thereafter opening, by electrical operation, at least one valve in the buoy to each of the at least one riser in response to commands received from the external site positioned at the location being geographically separated from the offshore injection site containing the subsea template and from the vessel; and thereafter opening at least one valve in the subsea template to each of the at least one riser.

13. The method according to claim 12 wherein the measuring of the at least one respective pressure level in each of the at least one riser and determining the respective equalization pressure for each of the at least one riser comprises:

measuring a first respective pressure level in an upper section;

measuring a second respective pressure level in a lower section; and determining, the respective equalization pressure for each of the at least one riser as an average value of the first and second respective pressure levels.

14. A method for disconnecting a passage for a fluid from a vessel on a water surface to a subsea template located on a seabed, which subsea template is configured to inject the fluid further into a subterranean void via a drill hole, the vessel being in fluid connection with the subsea template by means of a buoy and at least one riser, the method comprising:

while the fluid is being passed from the vessel into the subterranean void, injecting at least one assisting liquid into each of the at least one riser;

shutting off the passage of fluid from the vessel to the at least one riser by closing, by electrical operation, a respective at least one valve in the buoy in response to commands received from the external site positioned at the location being geographically separated from the offshore injection site containing the subsea template and from the vessel;

measuring a pressure level in each of the at least one riser;

continuing to inject the fluid into the subterranean void via the at least one riser until the pressure level in each of the at least one riser has reached an equalization level, and after that the pressure level in each of the at least one riser has reached the equalization level closing a respective at least one valve in the subsea template to each of the at least one riser.

15. The method according to claim 14, comprising closing the respective at least one valve in the subsea template automatically in response the pressure level in each of the at least one riser reaching the equalization level.

16. The method according to claim 14, further comprising:

closing the respective at least one valve in the buoy if the buoy becomes disconnected from the vessel while the fluid passes out from the vessel and into the at least one riser.

* * * * *